US010660480B1

(12) United States Patent
Askins et al.

(10) Patent No.: US 10,660,480 B1
(45) Date of Patent: May 26, 2020

(54) ADJUSTABLE BATHTUB/SHOWER SEAT AND ASSOCIATED USE THEREOF

(71) Applicants: Audrey C. Askins, Calumet City, IL (US); Norma J. Smith, Chicago, IL (US)

(72) Inventors: Audrey C. Askins, Calumet City, IL (US); Norma J. Smith, Chicago, IL (US)

( * ) Notice: Subject to any disclaimer, the term of this patent is extended or adjusted under 35 U.S.C. 154(b) by 26 days.

(21) Appl. No.: 15/975,652

(22) Filed: May 9, 2018

Related U.S. Application Data

(60) Provisional application No. 62/503,599, filed on May 9, 2017.

(51) Int. Cl.

| | |
|---|---|
| ***A47K 3/28*** | (2006.01) |
| ***A47K 3/12*** | (2006.01) |
| ***A47C 3/30*** | (2006.01) |
| ***A47C 1/024*** | (2006.01) |

(52) U.S. Cl.
CPC ..... *A47K 3/282* (2013.01); *A47C 1/0242* (2013.01); *A47C 1/0244* (2013.01); *A47C 3/30* (2013.01); *A47K 3/122* (2013.01)

(58) Field of Classification Search
CPC ..... A47K 3/282; A47C 1/0242
USPC ..... 4/578.1
See application file for complete search history.

(56) References Cited

U.S. PATENT DOCUMENTS

2006/0087097 A1* 4/2006 Kramer ..... A47C 7/62 280/304.1

* cited by examiner

*Primary Examiner* — Christine J Skubinna
(74) *Attorney, Agent, or Firm* — Ashkan Najafi

(57) ABSTRACT

The adjustable bathtub/shower seat includes a support and a backrest pivotally attached thereto, a base attached to the support, and a controller in communication with the support, the backrest, and the base. Advantageously, the base is selectively raised and lowered along a vertical path. Advantageously, the backrest is selectively pivoted about a horizontal fulcrum axis and along an arcuate path, wherein the horizontal fulcrum axis is registered orthogonal to the vertical path.

13 Claims, 10 Drawing Sheets

ADJUSTABLE BATHTUB/SHOWER SEAT AND ASSOCIATED USE THEREOF

CROSS REFERENCE TO RELATED APPLICATIONS

This is a non-provisional patent application that claims the benefit of U.S. provisional patent application No. 62/503,599 filed May 9, 2017, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to bathtub accessories and, more particularly, to an adjustable, remote controlled, motorized seat for use in a shower or bath for safely assisting the elderly and others who suffer from limited mobility in getting in and out of a bathtub/shower. When lowered down into the bathtub, the seat back will recline to allow for an easy, comfortable, and relaxing bathing experience.

Prior Art

With today's heightened awareness of health concerns and constantly improving medical care, Americans are living longer than ever before. As the baby boomer generation gets older, dramatic increases are expected in the elderly population. In fact, the U.S. Bureau of the Census estimates that people 65 and older will comprise 20.4 percent of the country's population by the year 2030, up from the current 13 percent. However, if the unprecedented increase in life expectancy has a downside, it is the exposure of risk to chronic age-related disorders. Such serious ailments as diabetes, Alzheimer's and Parkinson's diseases are but a few of the disabling disorders that keep many older persons from enjoying their longevity.

Additionally, the elderly also has to deal with physical infirmities brought on by the inevitability of aging. The scientific journal Age and Aging reports that some 50% of persons over age 65 have osteoarthritis, and one-half of those are seriously disabled by the disease. However, challenges presented to those with limited mobility are not exclusive to the elderly. According to other statistics provided by the Census Bureau, nearly 8 percent of Americans between the ages of 15 and 64 suffer from some form of disability that hinders independent movement. Adding to these numbers are those with more temporary ailments, such as broken bones or postoperative conditions.

As many with limited mobility can easily attest, attempting to complete day to day tasks without assistance can be daunting and frustrating. Arthritic patients often find it very difficult, if not impossible, to lower themselves to or rise from a seated position without experiencing extreme pain. Similarly, those recovering from hip or knee replacement surgery are unable to enjoy a refreshing and cleansing bath due to their inability to bend or kneel into the bathtub. Additionally, these mobility challenges contain a high degree of risk. Those without caregivers to lend a hand or without the proper equipment to support movement could seriously injure themselves in spills and falls, possibly fracturing bones or even breaking their hip. As a result, their condition could be effectively worsened.

Accordingly, a need remains for adjustable bathtub/shower seat in order to overcome at least one of the above-noted shortcomings. The exemplary embodiment(s) satisfy such a need by an adjustable, remote controlled, motorized seat for use in a shower or bath that is convenient and easy to use, lightweight yet durable in design, versatile in its applications, and designed for safely assisting the elderly and others who suffer from limited mobility in getting in and out of a bathtub/shower. When lowered down into the bathtub, the seat back will recline to allow for an easy, comfortable, and relaxing bathing experience.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide an adjustable bathtub/shower seat for safely assisting a user having limited mobility in getting in and out of a bathtub/shower. These and other objects, features, and advantages of the non-limiting exemplary embodiment(s) are provided by an adjustable bathtub/shower seat including a support and a backrest pivotally attached thereto, a base attached to the support, and a controller in communication with the support, the backrest, and the base. Advantageously, the base is selectively raised and lowered along a vertical path. Advantageously, the backrest is selectively pivoted about a horizontal fulcrum axis and along an arcuate path, wherein the horizontal fulcrum axis is registered orthogonal to the vertical path.

In a non-limiting exemplary embodiment, the seat includes a top surface suitably sized and shaped to receive a user buttock thereon, and an enclosure directly attached to a bottom side of the top surface. Such an enclosure includes a cavity, a pair of static arms extended outwardly towards a posterior side of the support, and a central aperture in fluid communication with the cavity, and a hydraulic power pack housed within the enclosure and including fluid-transport tubes egressing the enclosure via the central aperture. Notably, the backrest includes a pair of braces rotatably coupled to the pair of static arms, respectively.

In a non-limiting exemplary embodiment, the seat further includes a hinge mechanism statically coupled to the backrest and located exterior of the enclosure, and a first hydraulic cylinder partially housed within the enclosure and extended outwardly therefrom such that the first hydraulic cylinder is coupled to the hinge mechanism. In this manner, the first hydraulic cylinder is operably connected to a corresponding one of the fluid-transport tubes.

In a non-limiting exemplary embodiment, the base includes a flexible outer covering aligned along the vertical path, and a second hydraulic cylinder partially housed within the flexible outer covering and extended outwardly therefrom such that the second hydraulic cylinder ingresses and engages the enclosure. Notably, the second hydraulic cylinder is operably connected to another one of the fluid-transport tubes.

In a non-limiting exemplary embodiment, the first hydraulic cylinder horizontally reciprocates along a horizontal path and causes the backrest to articulate along the arcuate path.

In a non-limiting exemplary embodiment, the second hydraulic cylinder reciprocates along the vertical path and causes the support to rise and fall.

In a non-limiting exemplary embodiment, the first hydraulic cylinder is independently and simultaneously operable relative to the second hydraulic cylinder.

The present disclosure further includes a method of using an adjustable bathtub/shower seat for safely assisting a user having limited mobility in getting in and out of a bathtub/shower. Such a method includes the steps of: providing a bathtub; providing a support; providing and pivotally attaching a backrest to the support; providing and attaching a base to the support; providing a controller in communication with the support, the backrest, and the base; placing the adjustable bathtub/shower seat in the bathtub; sitting on the support and swiveling the support to a desired position; selectively raising and lowering the base along a vertical path to a desired height; selectively pivoting the backrest about a horizontal fulcrum axis and along an arcuate path to a desired position wherein the horizontal fulcrum axis is registered orthogonal to the vertical path; filling up the bathtub with water to a desired water level above the desired height of the base; and taking a bath.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
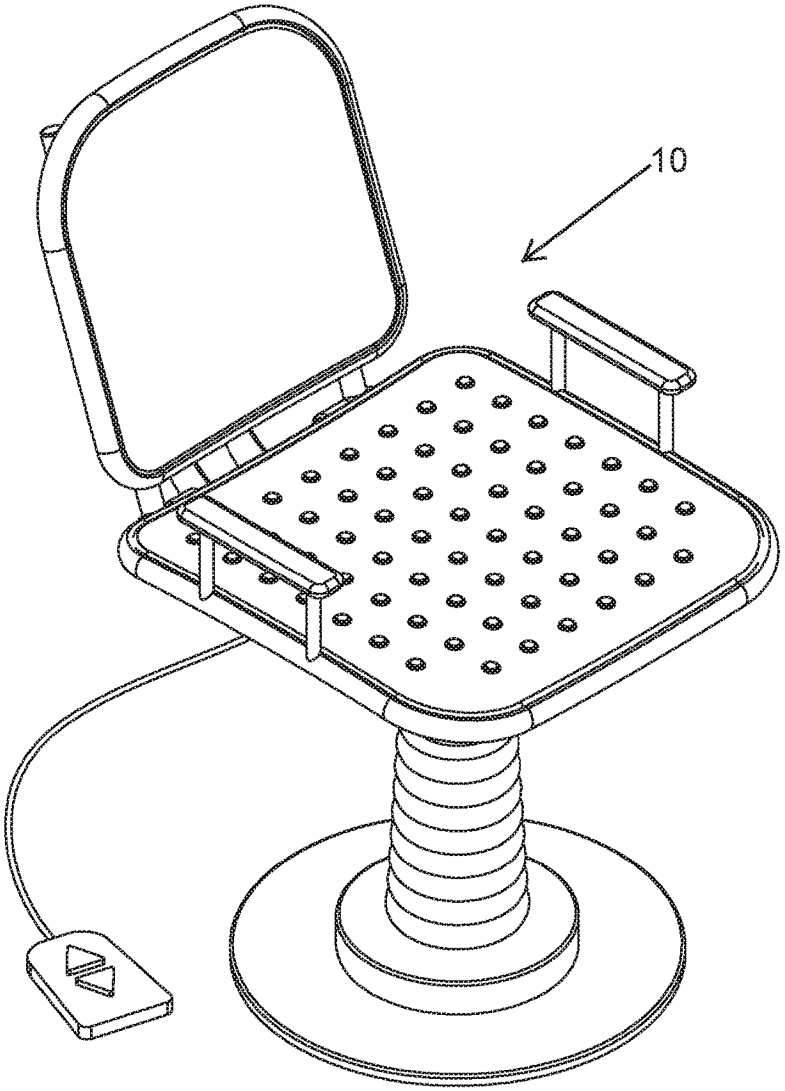
FIG. 1 is a perspective view of an adjustable bathtub/shower seat, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

Figure 3:
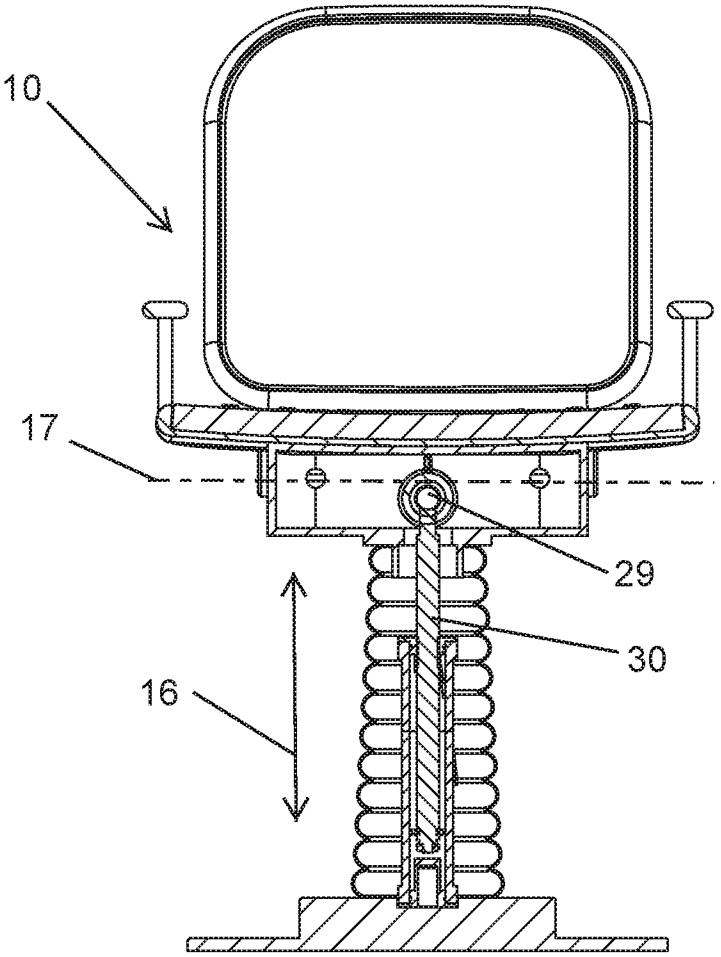
FIG. 3 is a cross-sectional view taken along line 3-3 in FIG. 2.
Figure 2:
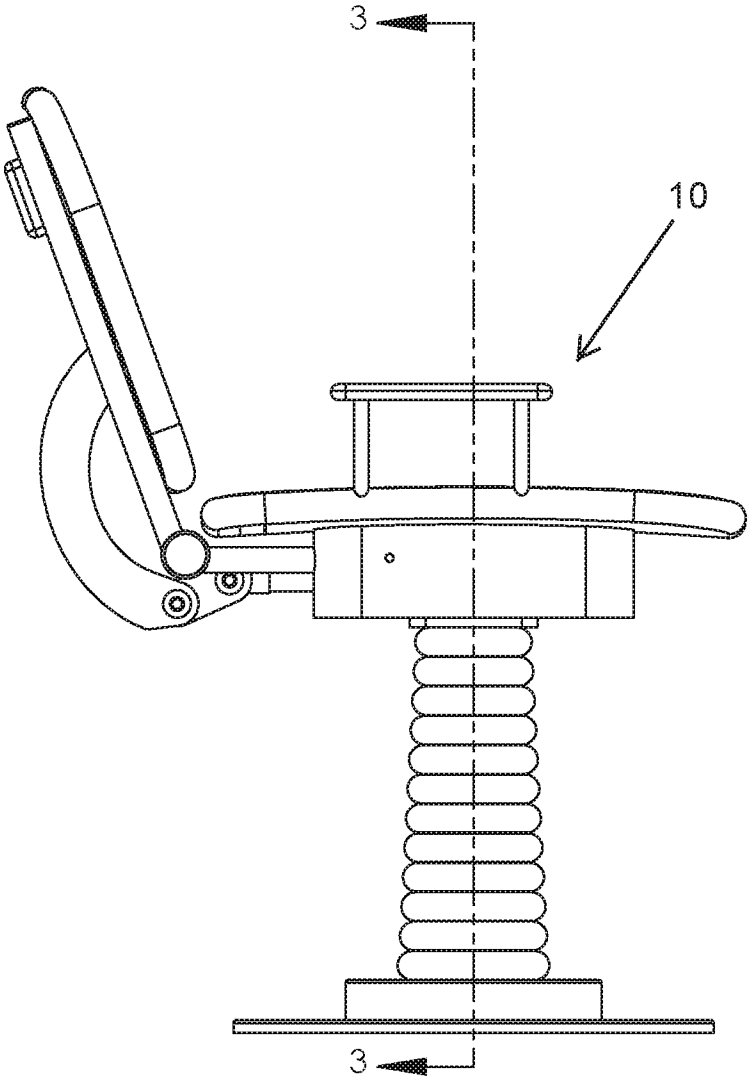
FIG. 2 is a side elevational view of the adjustable bathtub/shower seat shown in FIG. 1.
Figure 5:
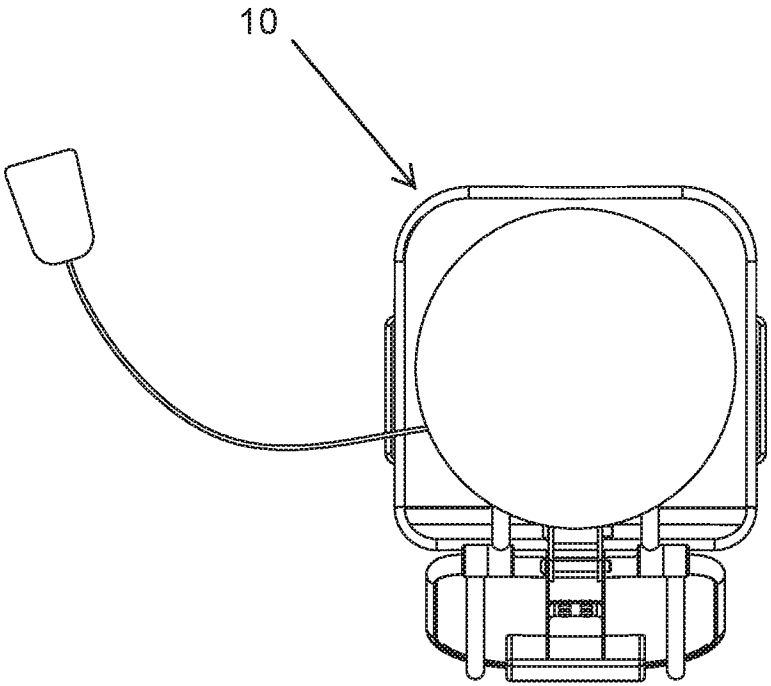
FIG. 5 is a bottom plan view of the adjustable bathtub/shower seat shown in FIG. 1.
Figure 4:
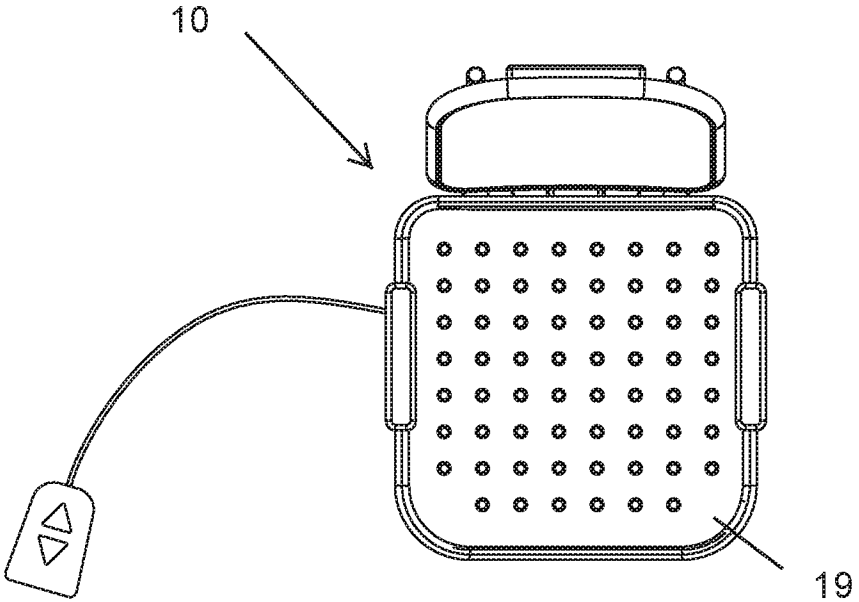
FIG. 4 is a top plan view of the adjustable bathtub/shower seat shown in FIG. 1.
Figure 7:
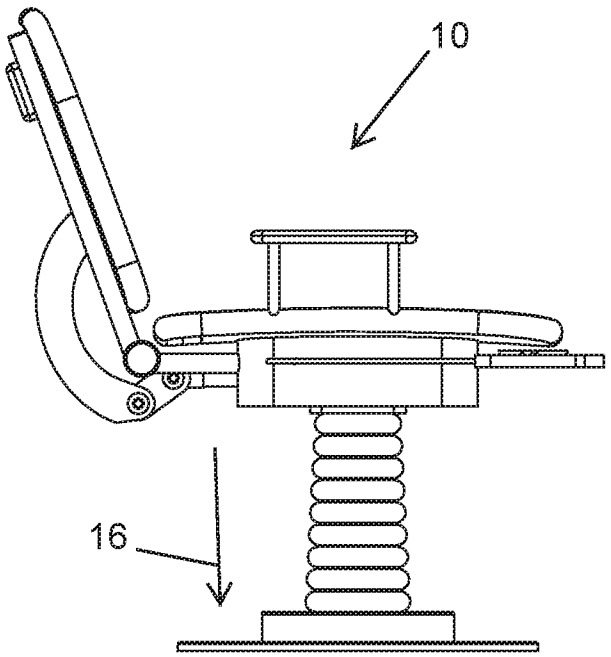
FIG. 7 is a side elevational view of the adjustable bathtub/shower seat at a lowered position.
Figure 6:
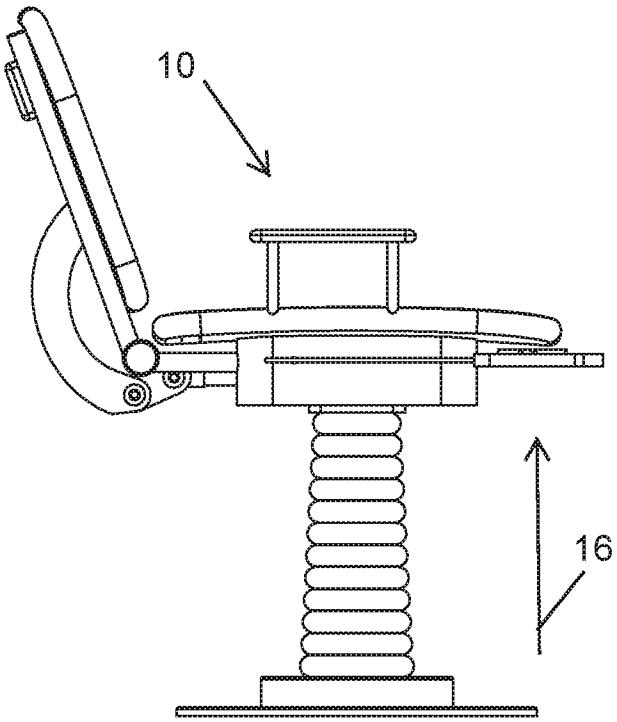
FIG. 6 is a side elevational view of the adjustable bathtub/shower seat at a raised position.
Figure 9:
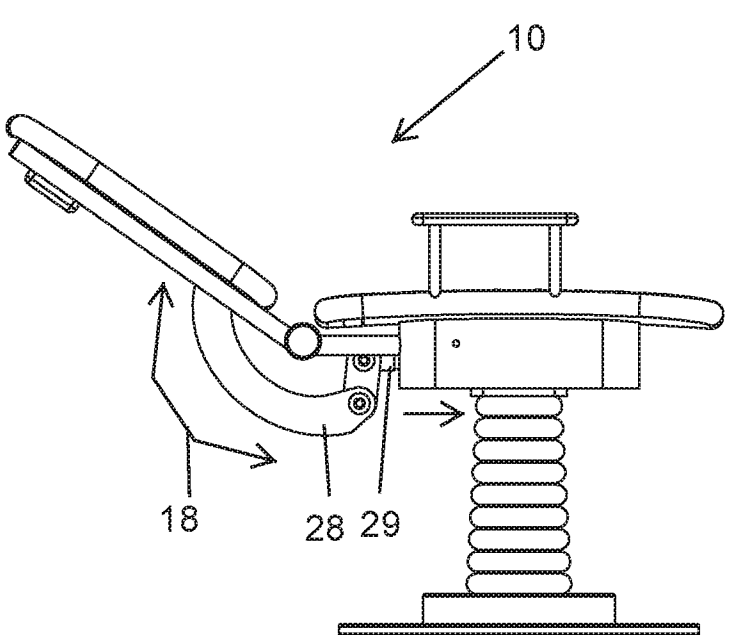
FIG. 9 is a side elevational view of the adjustable bathtub/shower seat at a less reclined position.
Figure 8:
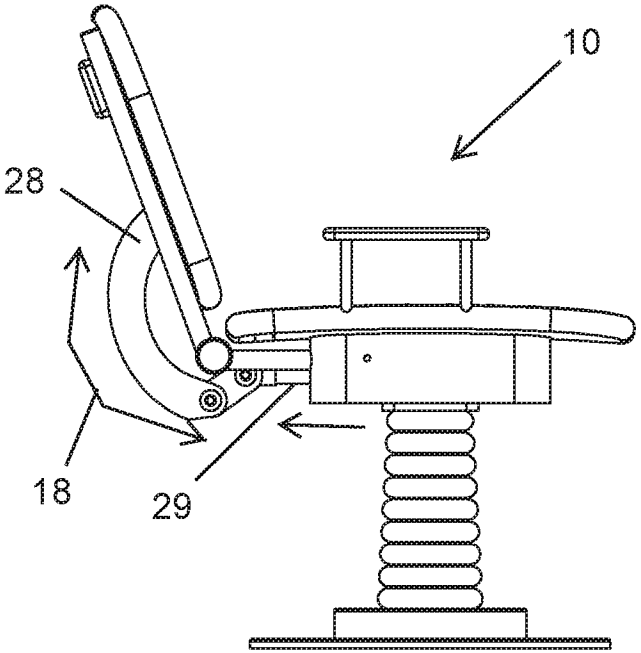
FIG. 8 is a side elevational view of the adjustable bathtub/shower seat at a more reclined position.
Figure 10:
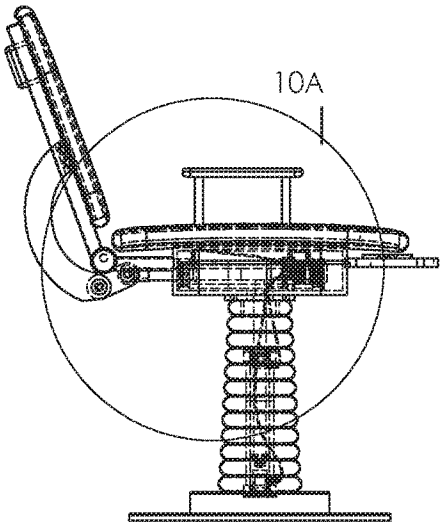
FIG. 10 is transparent view showing the interrelationship between the major mechanical/electrical components of the adjustable bathtub/shower seat.
Figure 10A:
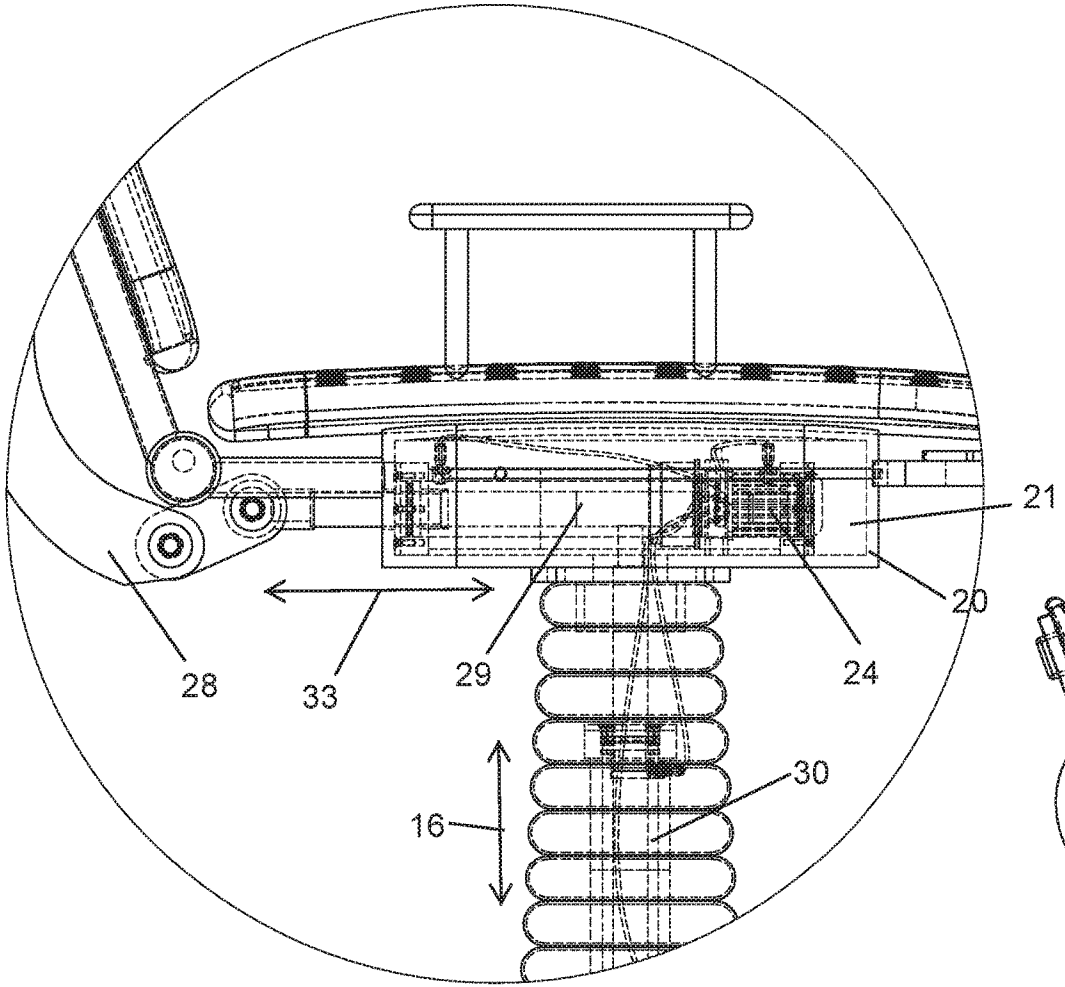
FIG. 10A is an enlarged view of section 10A taken in FIG. 10.
Figure 11:
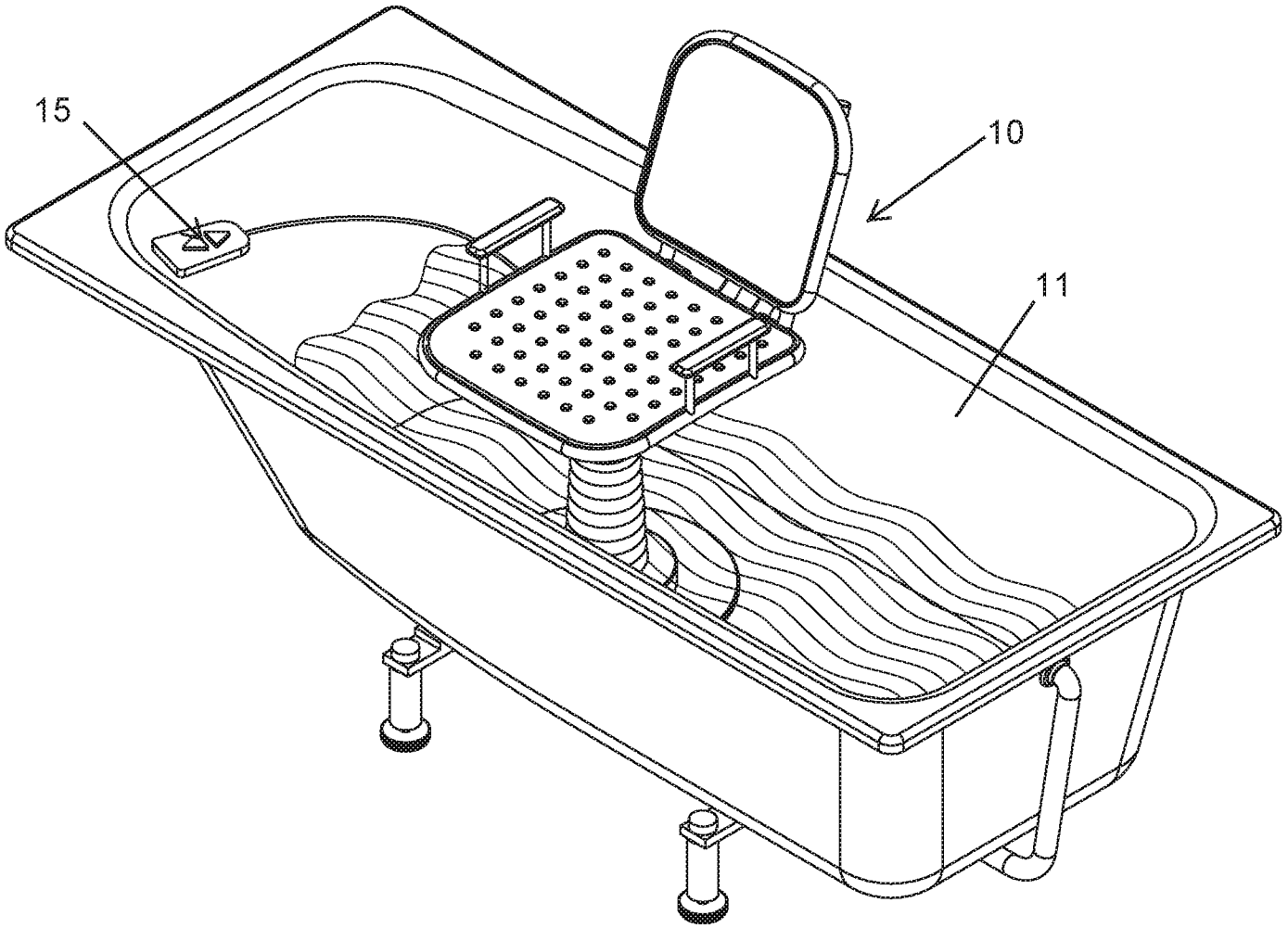
FIG. 11 is a perspective view of the adjustable bathtub/shower seat at a raised and upright position and disposed in a partially filled bathtub.
Figure 12:
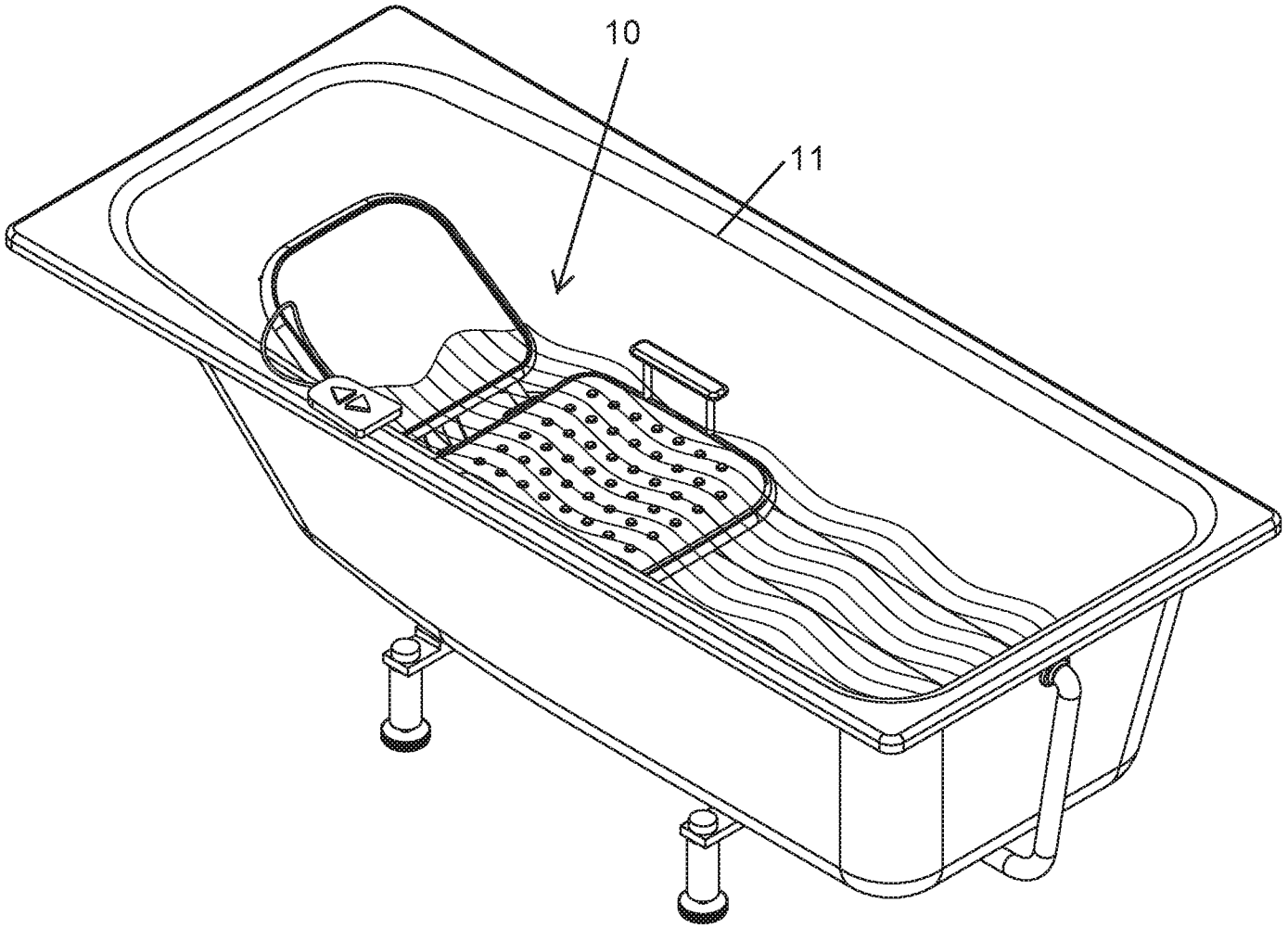
FIG. 12 is a perspective view of the adjustable bathtub/shower seat at a lowered and reclined position and disposed in the partially filled bathtub.
Figure 13:
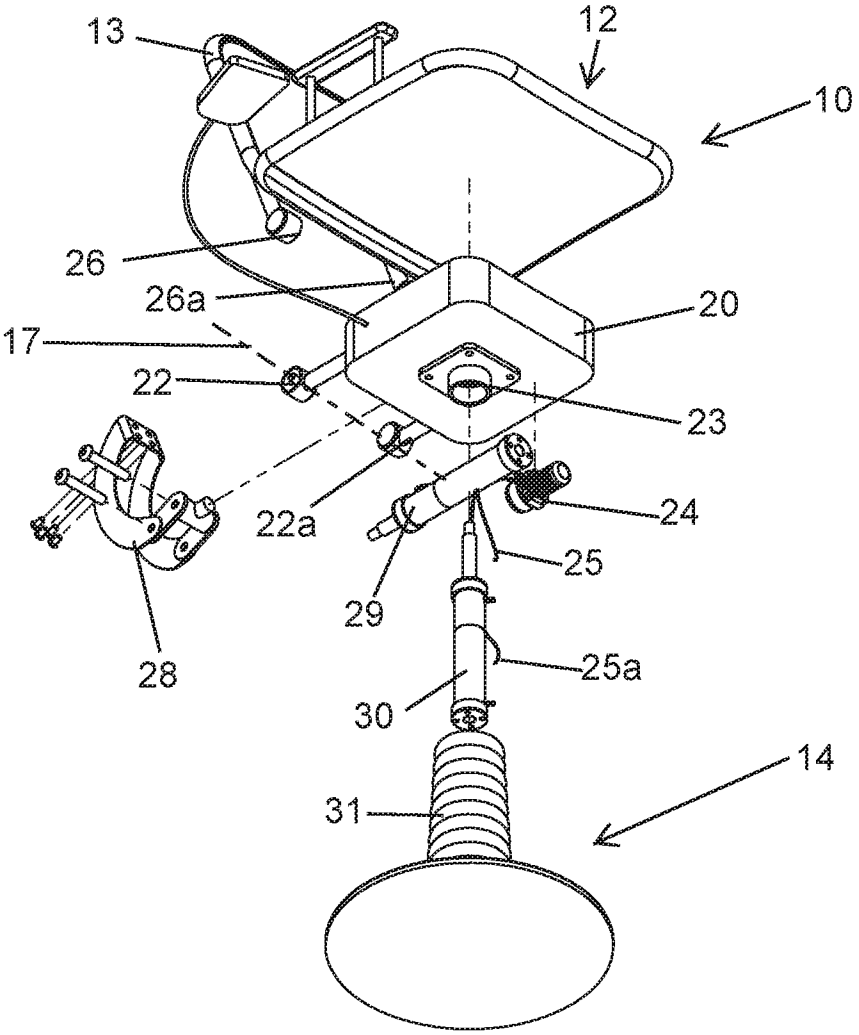
FIG. 13 is an exploded view of the adjustable bathtub/shower seat.
Figure 14A:
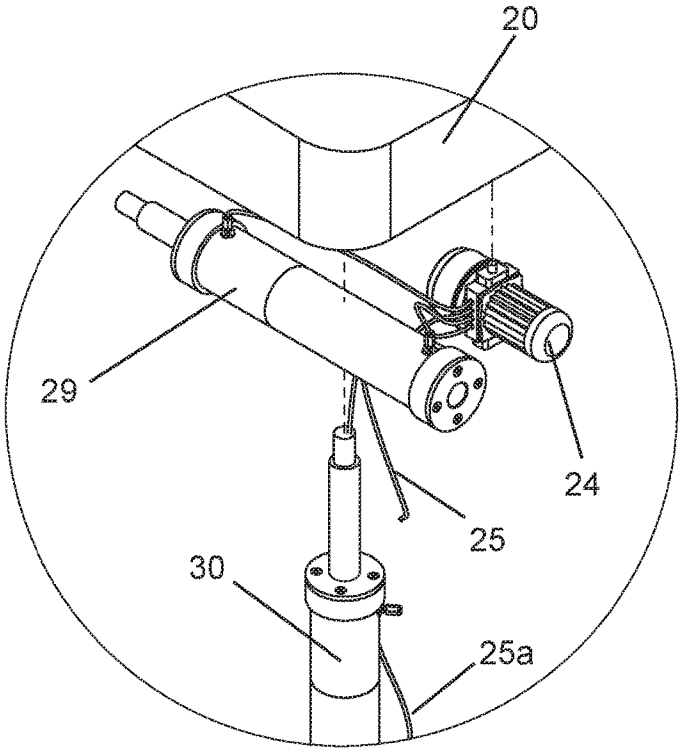
FIG. 14A is an enlarged view of section 14A taken in FIG. 14.
Figure 14:
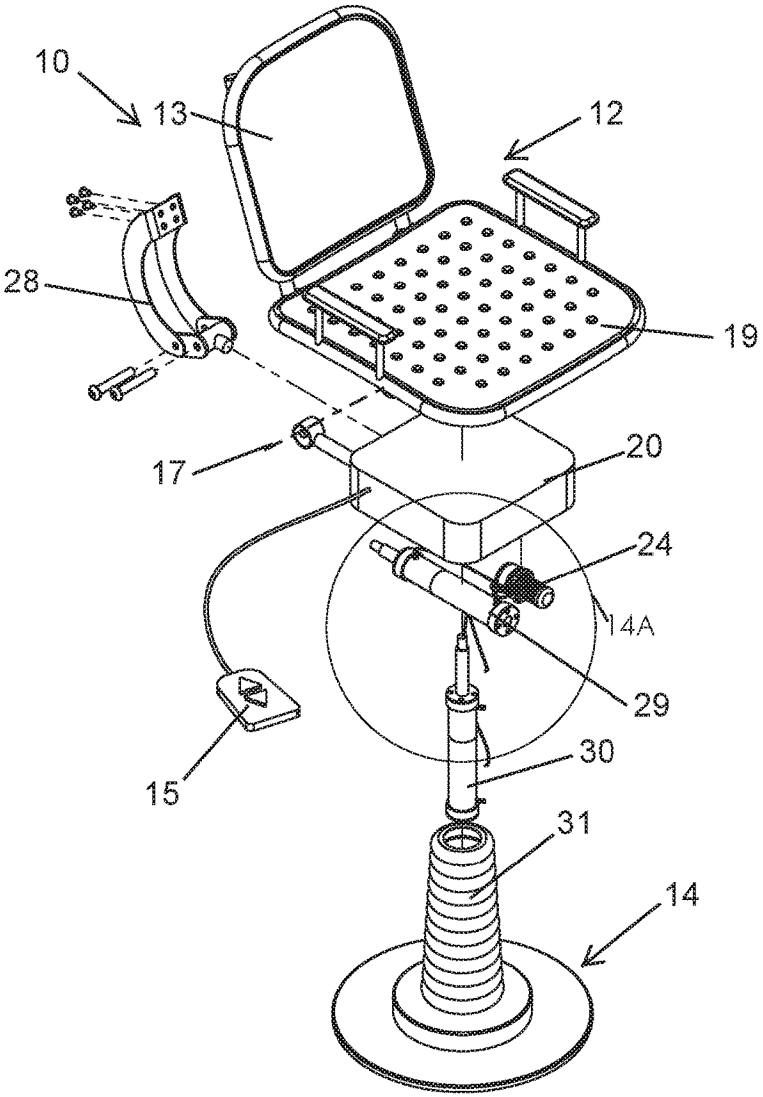
FIG. 14 is another exploded view of the adjustable bathtub/shower seat.

A non-limiting exemplary embodiment(s) of the present disclosure is referred to in FIGS. 1-14A and is intended to provide an adjustable, remote controlled, motorized seat 10 for use in a shower or bathtub (collectively at 11) for safely assisting the elderly and others who suffer from limited mobility in getting in and out of a bathtub/shower 11. When lowered down into the bathtub 11, the backrest 13 will recline to allow for an easy, comfortable, and relaxing bathing experience. It should be understood that the exemplary embodiment(s) may be used with a variety of bathtubs/showers 11, and should not be limited to any particular bathtub/shower described herein.

Referring to FIGS. 1-14A, the adjustable bathtub/shower seat 10 includes a support 12 and a backrest 13 pivotally attached thereto, a base 14 attached to the support 12, and a controller 15 in communication with the support 12, the backrest 13, and the base 14. Advantageously, the base 14 is selectively raised and lowered along a vertical path 16 to a desired height. Advantageously, the backrest 13 is selectively pivoted about a horizontal fulcrum axis 17 and along an arcuate path 18 to a desired position, wherein the horizontal fulcrum axis 17 is registered orthogonal to the vertical path 16.

In a non-limiting exemplary embodiment, the support 12 includes a top surface 19 suitably sized and shaped to receive a user buttock thereon, and an enclosure 20 directly attached to a bottom side of the top surface 19. Such an enclosure 20 includes a cavity 21, a pair of static arms 22, 22*a* extended outwardly towards a posterior side of the support 12, and a central aperture 23 in fluid communication with the cavity 21. A hydraulic power pack 24 is housed within the enclosure 20 and includes fluid-transport tubes 25, 25*a* egressing the enclosure 20 via the central aperture 23. Notably, the backrest 13 includes a pair of braces 26, 26*a* rotatably coupled to the pair of static arms 22, 22*a*, respectively.

In a non-limiting exemplary embodiment, the support 10 further includes a hinge mechanism 28 statically coupled to the backrest 13 and located exterior of the enclosure 20, and a first hydraulic cylinder 29 partially housed within the enclosure 20 and extended outwardly therefrom such that the first hydraulic cylinder 29 is coupled to the hinge mechanism 28. Notably, the first hydraulic cylinder 29 is operably connected to a corresponding one of the fluid-transport tubes 25, 25*a*.

In a non-limiting exemplary embodiment, the base 14 includes a flexible outer covering 31 aligned along the vertical path 16, and a second hydraulic cylinder 30 partially housed within the flexible outer covering 31 and extended outwardly therefrom such that the second hydraulic cylinder 30 ingresses and engages the enclosure 20. Notably, the second hydraulic cylinder 30 is operably connected to another one of the fluid-transport tubes 25, 25*a*.

In a non-limiting exemplary embodiment, the first hydraulic cylinder 29 horizontally reciprocates along a horizontal path 33 and causes the backrest 13 to articulate along the arcuate path 18. In particular, as the first hydraulic cylinder 29 is linearly extended posteriorly away from the enclosure 20, the hinge mechanism 28 forces the backrest 13 towards an upright position (vertical position). Conversely, as the first hydraulic cylinder 29 is linearly retracted anteriorly towards the enclosure 20, the hinge mechanism 28 allows the backrest 13 to articulate towards a reclined position (horizontal position).

In a non-limiting exemplary embodiment, the second hydraulic cylinder 30 reciprocates along the vertical path 16 and causes the support 12 to rise and fall.

In a non-limiting exemplary embodiment, the first hydraulic cylinder 29 is independently and simultaneously operable relative to the second hydraulic cylinder 30.

The present disclosure further includes a method of using an adjustable bathtub/shower seat 10 for safely assisting a user having limited mobility in getting in and out of a bathtub/shower 11. Such a method includes the steps of: providing a bathtub 11; providing a support 12; providing and pivotally attaching a backrest 13 to the support 12; providing and attaching a base 14 to the support 12; providing a controller 15 in communication with the support 12, the backrest 13, and the base 14; placing the adjustable bathtub/shower seat 10 in the bathtub 11; sitting on the support 12 and swiveling the support 12 to a desired position; selectively raising and lowering the base 14 along a vertical path 16 to a desired height; selectively pivoting the backrest 13 about a horizontal fulcrum axis 17 and along an arcuate path 18 to a desired position wherein the horizontal fulcrum axis 17 is registered orthogonal to the vertical path 16; filling up the bathtub 11 with water to a desired water level above the desired height of the base 14; and taking a bath.

Referring to the figures in general, in a non-limiting exemplary embodiment(s), the adjustable bathtub/shower seat 10 is a motorized, stool-type booster seat specially designed to keep users at a safe, elevated position when in the bath or shower 11. Rectangular in shape and fabricated of a sturdy, high quality, waterproof plastic material, the product may measure approximately fourteen inches (14") in the seating area, with a height of up to sixteen and one half inches (161/2") fully extended, for example. To facilitate secure installation onto the floor of the tub or shower 11 area, a series of large, strong suction cups can be positioned on the bottom of the adjustable bathtub/shower seat 10. Generally oval in shape, the seat 10 itself could be foam padded and covered with a strong and durable reinforced nylon material.

In a non-limiting exemplary embodiment, integrally attached to the seat 10, metal bracing legs that are swivel connected in a crisscross pattern can be sheathed in a heavy duty, waterproof plastic material. The legs of the adjustable bathtub/shower seat 10 may lead down to this product's base 14, which may be a metal framed track bordering the unit on both sides. Also protected with plastic, the track may serve as a guide for the legs as the seat 10 is adjusted. The adjustable bathtub/shower chair 10 may be operated by a small, motorized hydraulic pump (power pack), included with this product. Connected to the chair track via tubular hosing, this pump may be controlled by a remote operating device located on the arm of the chair. Facilitating adjustability of the chair, the pump's remote control may feature a button that may position the unit "Up" or "Down", as well as "Upright" or "Laid-Down".

As an additional consideration, this product could be made available in a variety of colors and styles to appeal to individual tastes or to match the décor of any bathroom.

Use of the adjustable bathtub/shower chair 10 includes placing the raised chair into an empty bathtub 11, the user may then simply sit down, and swivel the seat 10 around so that he or she is over the tub area. With an easy flick of the button on the control panel to the "Down" position, the seat 10 then gently lowers the user into the tub. Next, the user may fill the tub with water and enjoy a relaxing bath. When the bath is complete, and the user is ready to emerge, all water is first drained from the bathtub 11. Sliding the control panel button to "Up," the chair is then lifted, raising the user above the edge of the tub. From this higher vantage point, the user may be able to rotate the chair so that it is facing forward, lower the feet to the floor, and stand up, walking away from the bathtub 11.

There are many significant benefits and advantages associated with the adjustable bathtub/shower chair 10. Foremost, this unique and practical product may allow consumers who suffer with mobility problems to enter and exit a bathtub 11 in an expedient and easy manner. These users will appreciate that the adjustable bathtub/shower chair 10 may provide a pain-free means for them to enjoy a warm, soothing bath, whether they were basking in relaxing bubbles and oils or soaking in medicinal ointments to ease aching joints and muscles. Conducive to an easy transfer to and from the bathtub 11, the adjustable bathtub/shower seat 10 has elevated capabilities that allow users to confidently ease themselves from an upright position onto the seat 10. As the height afforded by this product may provide sufficient clearance from the sides of the bathtub 11, users could also simply step off the seat 10 and back into a standing position upon completion of the bath.

Lightweight yet durable, the water-resistant, reinforced construction of the adjustable bathtub/shower seat 10 may ensure years of continued use. In addition, the sturdy and comfortable adjustable bathtub/shower seat 10 may foster a renewed sense of independence and self-sufficiency in elderly patients afflicted with arthritis or similar ailments. Not just for the older population, this cleverly designed product may also prove invaluable to anyone with mobility challenges, from sufferers of palsy or scoliosis to those recovering 31 from joint replacement surgery or broken bones. Though primarily intended for home use, the adjustable bathtub/shower seat 10 may be very beneficial to hospitals, and especially nursing homes and rehabilitation centers.

The adjustable bathtub/shower seat 10 is an innovative product that offers consumers with mobility-impairing ailments an easy and comfortable way to lower themselves into and raise themselves out of a bathtub 11. User friendly and versatile, this practical unit's elevation and strong construction would allow its users to return to completing the everyday and enjoyable task of bathing in a pain-free and confident manner. Affordably priced, the adjustable bathtub/shower seat 10 will be well received by the elderly or anyone with limited mobility.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. An adjustable bathtub/shower seat for safely assisting a user having limited mobility in getting in and out of a bathtub/shower, said adjustable bathtub/shower seat comprising:

a support and a backrest attached thereto;

a base attached to said support; and a controller in communication with said support, said backrest, and said base;

wherein said base is selectively raised and lowered along a vertical path;

wherein said backrest is selectively pivoted about a horizontal fulcrum axis and along an arcuate path;

wherein said horizontal fulcrum axis is registered orthogonal to said vertical path;

wherein said support comprises a top surface suitably sized and shaped to receive a user buttock thereon;

an enclosure directly attached to a bottom side of said top surface, said enclosure including a cavity, a pair of static arms extended outwardly towards a posterior side of said support, and a central aperture in fluid communication with said cavity; and a hydraulic power pack housed within said enclosure and including fluid-transport tubes egressing said enclosure via said central aperture;

wherein said backrest includes a pair of braces rotatably coupled to said pair of static arms, respectively.

2. The adjustable bathtub/shower seat of claim 1, wherein said support further comprises:

a hinge mechanism statically coupled to said backrest and located exterior of said enclosure; and a first hydraulic cylinder partially housed within said enclosure and extended outwardly therefrom such that said first hydraulic cylinder is coupled to said hinge mechanism;

wherein said first hydraulic cylinder is operably connected to a corresponding one of said fluid-transport tubes.

3. The adjustable bathtub/shower seat of claim 2, wherein said base comprises:

a flexible outer covering aligned along the vertical path; and a second hydraulic cylinder partially housed within said flexible outer covering and extended outwardly therefrom such that said second hydraulic cylinder ingresses and engages said enclosure;

wherein said second hydraulic cylinder is operably connected to another one of said fluid-transport tubes.

4. The adjustable bathtub/shower seat of claim 3, wherein said first hydraulic cylinder horizontally reciprocates along a horizontal path and causes said backrest to articulate along said arcuate path.

5. The adjustable bathtub/shower seat of claim 4, wherein said second hydraulic cylinder reciprocates along said vertical path and causes said seat to rise and fall.

6. The adjustable bathtub/shower seat of claim 5, wherein said first hydraulic cylinder is independently and simultaneously operable relative to said second hydraulic cylinder.

7. An adjustable bathtub/shower seat for safely assisting a user having limited mobility in getting in and out of a bathtub/shower, said adjustable bathtub/shower seat comprising:

a support and a backrest pivotally attached thereto;

a base attached to said support; and a controller in communication with said support, said backrest, and said base;

wherein said base is selectively raised and lowered along a vertical path;

wherein said backrest is selectively pivoted about a horizontal fulcrum axis and along an arcuate path;

wherein said horizontal fulcrum axis is registered orthogonal to said vertical path;

wherein said support comprises:

a top surface suitably sized and shaped to receive a user buttock thereon;

an enclosure directly attached to a bottom side of said top surface, said enclosure including a cavity, a pair of static arms extended outwardly towards a posterior side of said support, and a central aperture in fluid communication with said cavity; and a hydraulic power pack housed within said enclosure and including fluid-transport tubes egressing said enclosure via said central aperture;

wherein said backrest includes a pair of braces rotatably coupled to said pair of static arms, respectively.

8. The adjustable bathtub/shower seat of claim 7, wherein said support further comprises:

a hinge mechanism statically coupled to said backrest and located exterior of said enclosure; and a first hydraulic cylinder partially housed within said enclosure and extended outwardly therefrom such that said first hydraulic cylinder is coupled to said hinge mechanism;

wherein said first hydraulic cylinder is operably connected to a corresponding one of said fluid-transport tubes.

9. The adjustable bathtub/shower seat of claim 8, wherein said base comprises:

a flexible outer covering aligned along the vertical path; and a second hydraulic cylinder partially housed within said flexible outer covering and extended outwardly therefrom such that said second hydraulic cylinder ingresses and engages said enclosure;

wherein said second hydraulic cylinder is operably connected to another one of said fluid-transport tubes.

10. The adjustable bathtub/shower seat of claim 9, wherein said first hydraulic cylinder horizontally reciprocates along a horizontal path and causes said backrest to articulate along said arcuate path.

11. The adjustable bathtub/shower seat of claim 10, wherein said second hydraulic cylinder reciprocates along said vertical path and causes said support to rise and fall.

12. The adjustable bathtub/shower seat of claim 11, wherein said first hydraulic cylinder is independently and simultaneously operable relative to said second hydraulic cylinder.

13. A method of using an adjustable bathtub/shower seat for safely assisting a user having limited mobility in getting in and out of a bathtub/shower, said method comprising the steps of:

providing a bathtub;

providing a support;

providing and pivotally attaching a backrest to said support;

providing and attaching a base to said support;

providing a controller in communication with said support, said backrest, and said base;

placing said adjustable bathtub/shower seat in said bathtub;

sitting on said support and swiveling said support to a desired position;

selectively raising and lowering said base along a vertical path to a desired height;

selectively pivoting said backrest about a horizontal fulcrum axis and along an arcuate path to a desired position, wherein said horizontal fulcrum axis is registered orthogonal to said vertical path;

filling up the bathtub with water to a desired water level above the desired height of said base; and taking a bath;

wherein said support comprises:

a top surface suitably sized and shaped to receive a user buttock thereon;

an enclosure directly attached to a bottom side of said top surface, said enclosure including a cavity, a pair of static arms extended outwardly towards a posterior side of said support, and a central aperture in fluid communication with said cavity; and a hydraulic power pack housed within said enclosure and including fluid-transport tubes egressing said enclosure via said central aperture;

wherein said backrest includes a pair of braces rotatably coupled to said pair of static arms, respectively.

* * * * *